US005876274A

United States Patent [19]

Hariu

[11] Patent Number: 5,876,274

[45] Date of Patent: Mar. 2, 1999

[54] CORRUGATED ELECTRODEPOSITED DIAMOND WHEEL

[75] Inventor: Shuichi Hariu, Kanagawa, Japan

[73] Assignee: Sankyo Diamond Industrial Co., Ltd., Kanagawa, Japan

[21] Appl. No.: 792,870

[22] Filed: Jan. 31, 1997

[30] Foreign Application Priority Data

Dec. 27, 1996 [JP] Japan ..... 8-356797

[51] Int. Cl.[6] ..... B24B 55/02; B28D 1/04

[52] U.S. Cl. ..... 451/547; 451/449; 451/548; 125/15

[58] Field of Search ..... 125/15, 18; 451/449, 451/488, 527, 541, 544, 547, 548, 528

[56] References Cited

U.S. PATENT DOCUMENTS

| | | | |
|---|---|---|---|
| 903,933 | 11/1908 | Williams, Jr. et al. | 125/15 X |
| 2,087,012 | 7/1937 | Zimmerman | 451/488 X |
| 2,334,642 | 11/1943 | Moore et al. | 451/488 |
| 3,491,742 | 1/1970 | Weiss | 125/15 |
| 3,754,359 | 8/1973 | Scandalestos | 451/488 |
| 4,624,237 | 11/1986 | Inoue | 125/15 |
| 5,308,367 | 5/1994 | Julien | 51/293 |
| 5,364,422 | 11/1994 | Kitazjima et al. | 451/541 X |
| 5,399,116 | 3/1995 | Ellis et al. | 451/540 |

FOREIGN PATENT DOCUMENTS 0 083 380 A1 7/1983 European Pat. Off. .

*Primary Examiner*—Timothy V. Eley
*Attorney, Agent, or Firm*—Kubovcik & Kubovcik

[57] ABSTRACT

An electrodeposited diamond wheel including a circular substrate having an attaching aperture formed at the center and a plurality of cooling apertures each formed at a predetermined distance from the attaching aperture in the outer circumferential direction and each at a predetermined pitch. Diamond abrasive particles are electrodeposited on the outer circumference of the circular substrate. Ridges and grooves are formed as corrugations on both surfaces of the circular disc, and diamond abrasive particles are electrodeposited on the outer circumference of the corrugations to form a cutting edge, the cutting edge being formed into a corrugated shape conforming to the substrate. The diamond wheel is suitable for cutting of a composite material of a heat-softening material and a reinforcing material.

10 Claims, 6 Drawing Sheets

CORRUGATED ELECTRODEPOSITED DIAMOND WHEEL

BACKGROUND OF THE INVENTION AND RELATED ART STATEMENT

The present invention concerns an electrodeposited diamond wheel suitable for cutting of a composite material and, more particularly, it relates to an electrodeposited diamond wheel suitable for cutting of a composite material that contains a metal wire, glass fiber or carbon fiber as reinforcing material in a heat-softening material, for example, a thermoplastic material, rubber material or resin material.

At present, a blade (so-called cutter) is used for cutting a heat-softening material such as rubber, synthetic resin or thermoplastic material.

However, when a composite material including metal wire, glass fiber or carbon fiber as a reinforcing material in a heat softening material, for example, a thermoplastic material, various kinds of rubber or synthetic resins, is cut using a cutter, there are various disadvantages.

That is, when a composite material including a reinforcing material such as metal, carbon fiber or glass fiber in a heat softening material is cut using a cutter, a blade portion impacts against a portion of the reinforcing material during cutting to violently damage the blade portion of the cutter, which significantly shortens the working life of the cutter, makes it necessary for frequent grinding of the damaged blade portion and is not practical.

OBJECT AND SUMMARY OF THE INVENTION

In view of the above, since a diamond wheel is effective for cutting a hard reinforcing material, use of a diamond wheel for the cutting of a composite material has been tried. However, the use of an existing diamond wheel for the cutting of a composite material comprising a thermosoftening material results in disadvantages that the heat softening material is softened or melted by the generation of heat such as frictional heat generated between the diamond wheel and the composite material during cutting and is deposited on the periphery of diamond abrasive particles of the diamond wheel. The material covers the diamond layer and makes cutting impossible.

That is, when cutting the heat-softening resin constituting a portion of the composite material, if a tool having cutting diamond abrasive particles disposed on the outer periphery of a disc such as a diamond wheel is used under high speed rotation, heat of friction is sometimes caused between the diamond wheel and the heat-softening material to be cut. Because of the heat of friction the heat-softening material to be cut is melted and deposited on the diamond abrasive particles and they do not contribute to the cutting.

As described above, no suitable cutting tool has been presented in the prior art capable of efficiently cutting a composite material comprising a heat-softening material and a reinforcing material.

An object of the present invention is to provide an electrodeposited diamond wheel capable of efficiently cutting a composite material comprising a heat-softening material and a reinforcing material.

An electrodeposited diamond wheel according to the present invention for cutting a composite material of a heat-softening material and a reinforcing material comprises a disc-like substrate having an attaching aperture at a center and a plurality of cooling apertures formed between the attaching aperture and the outer circumference of the wheel each at a predetermined distance and each at a predetermined pitch from each other. Diamond abrasive particles are electrodeposited on the outer circumference of the disc-like substrate. Both surfaces of the disc-like substrate are provided with corrugations forming ridges and grooves. Diamond abrasive particles are electrodeposited on the outer circumference of the corrugations to form a cutting edge, and the cutting edge is corrugated in a shape conforming to the corrugations of the substrate. By forming the cutting edge into a corrugated shape, it is possible to suppress temperature elevation caused by friction or the like generated by contact between the diamond wheel and a work to be cut thereby preventing the work from being thermally softened and enabling cutting to be smoothly conducted.

In this case, the ridges and the grooves are formed alternately on both surfaces of the disc-like substrate. This can reduce contact between the portion of the diamond abrasive particles on the circumference of the diamond wheel and the work to be cut, to prevent the work from heat-softening and also to prevent the heat-softening material from depositing on the diamond abrasive particles. At the same time, the corrugated substrate can provide a cooling effect by its rotation.

The size of the diamond abrasive particles used is suitably within a range of from 30 to 80 mesh and, more preferably, within a range of from 40 to 60 mesh. This is because if the size is less than 30 mesh, the number of cutting edges is insufficient and the diameter of the diamond abrasive particle is large and the force acting on the abrasive particles by the cutting force during cutting (so-called resistance force) becomes greater than the retaining force of the plating layer for retaining the abrasive particles. This brings about a disadvantage that the diamond abrasive particles are not retained in the plated layer, although they have a sufficient property as a cutting edge. Particularly, dislodging of the diamond abrasive particles occurs remarkably upon cutting the reinforcing material in the composite material. This remarkably shortens the working life of the product, which is not practical.

Further, if the size exceeds 80 mesh, the diameter of the diamond abrasive particles is small, and the number of abrasive particles is excessive. Additionally, the protrusion of the small diamond abrasive particles from the electrodeposited plating portion is insufficient and the plated portion can not serve as a cutting edge. Further, since the protrusion of the diamond abrasive particles from the plated layer is small, the composite material is in contact with the plated portion during cutting. Such contact generates heat and results in violent temperature elevation, which melts the heat-softening material and deposits the same on the diamond abrasive particles to deprive the diamond abrasive particles of effective cutting performance.

The burying ratio (explained below in conjunction with FIG. 7) of the diamond abrasive particles in the plating layer is preferably from 60% to 80%. If the burying ratio is less than 60%, although the cutting performance is satisfactory, the diamond abrasive particles are dislodged by force the exerted by cutting (the force is increased as the cutting edge of diamond is abraded). This phenomenon becomes more significant as the burying ratio becomes smaller. Accordingly, a ratio of less than 60% is not practical since the working life is shortened. On the other hand, if the ratio exceeds 80%, protrusion of the diamond particles from the plated layer is decreased causing contact between the composite material and the plated layer or making it impossible to discharge cutting dust during cutting, which causes heat generation and makes cutting impossible. This phenomenon becomes greater as the burying ratio is larger and it is not appropriate.

Further, it is preferred that the height of ridges in the corrugations of the substrate is gradually increased toward the outer circumference and that the width of the ridges is narrowed toward the center of the substrate. Such arrangement can reduce contacting area between the substrate and the composite material during cutting. This reduces the area of contact and can suppress generation of heat of friction caused by contact between the substrate and the work to be cut.

The ridges and the grooves are formed arcuately in a direction opposite to the intended direction of rotation of the substrate, such that an air stream can be formed from the central aperture to the outer circumference to provide an air cooling effect and, at the same time, make the discharge of cutting dust satisfactory.

Further, by constructing the substrate such that the thickness formed by a ridge on one surface and a ridge on the other surface of the corrugation situated at the outer circumference of the substrate is the largest thickness of the disc, the thickness at a portion of the diamond wheel electrodeposited with the diamond abrasive particles is the greatest. With this construction the cutting width is ensured and contact of the corrugating portion (ridged portion) of the substrate toward the inside (center) with the composite material is reduced. Further, if the substrate is made of a metal of a low heat expansion coefficient, thermal deformation of the substrate is reduced and the substrate can be maintained in a state of less contact with the work to be cut during use.

As described above according to the present invention, deposition of the work being cut on the diamond layer due to softening or melting can be prevented thereby suppressing temperature elevation.

That is, since the diamond abrasive particles as the cutting edge are corrugated in a shape comprising ridges and grooves, the area of contact of the diamond layer with the work to be cut can be reduced. Then, since the corrugations comprising ridges and grooves having the diamond abrasive particle(s) as the cutting edge are formed on both surfaces of the substrate, cutting dust can be easily discharged during cutting. Further, since the diamond wheel is used at a high speed of rotation, a cooling effect is provided by the corrugations on both surfaces of the substrate during cutting to suppress temperature elevation. While contact is inevitable between the substrate and the work to be cut, the contact with the corrugations of the substrate according to the present invention is remarkably reduced compared with existing products thereby enabling temperature elevation to be reduced. That is, if the area of contact between the diamond wheel and the work is large, heat is generated. As the result, the work to be cut is heat-softened or melted and deposited on the diamond abrasive particles making cutting impossible. The constitution of the present invention can remarkably reduce the area of contact with the work to be cut and can suppress the generation of heat.

DETAILED DESCRIPTION OF PREFERRED EMBODIMENTS

Preferred embodiments of the present invention will be explained with reference to the drawings. Components, arrangements and the like to be described hereinafter do not restrict the present invention and they can be modified or changed variously within the scope of the present invention.

Figure 1:
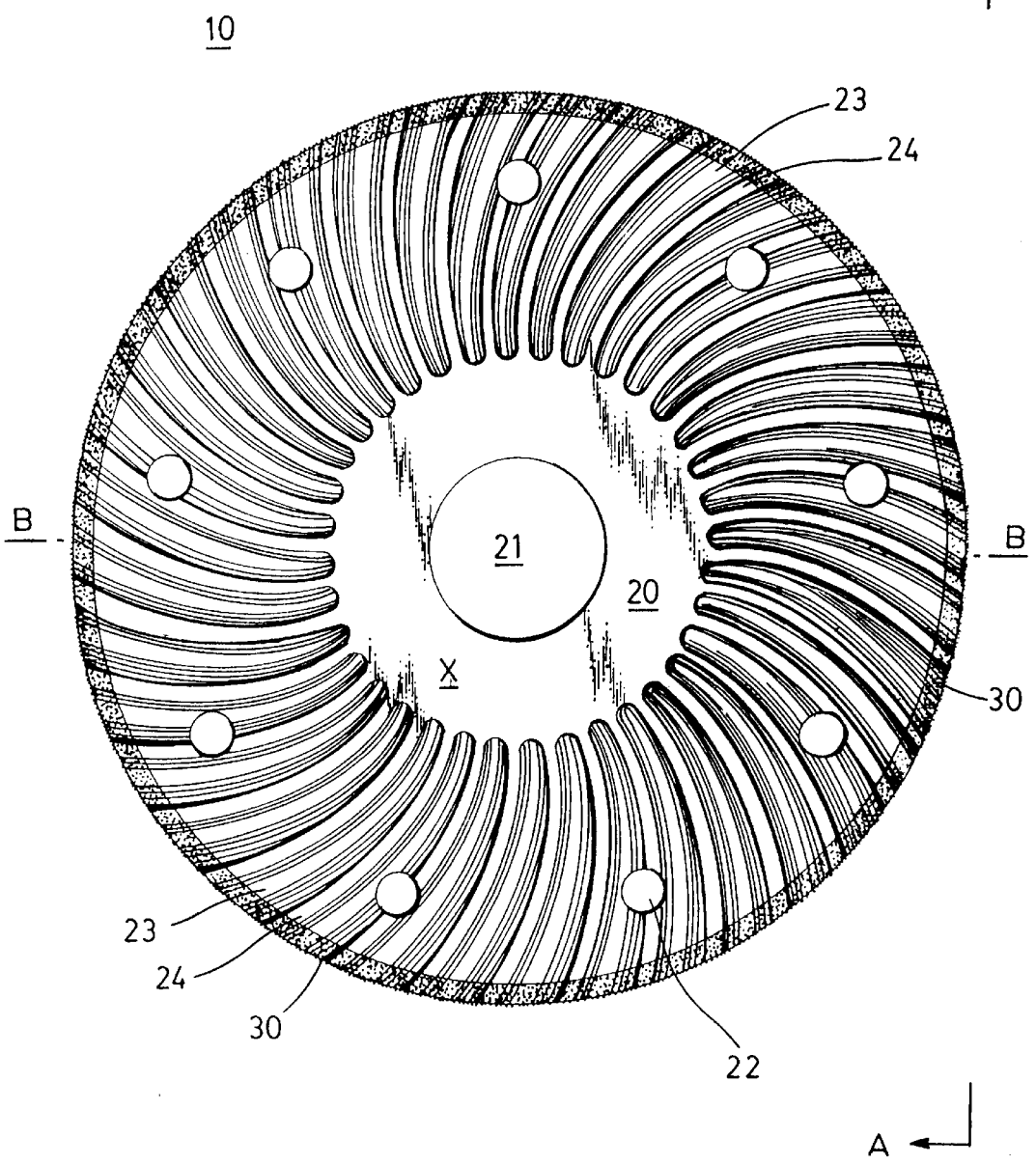
FIG. 1 is a front elevational view of a diamond wheel.
Figure 2:
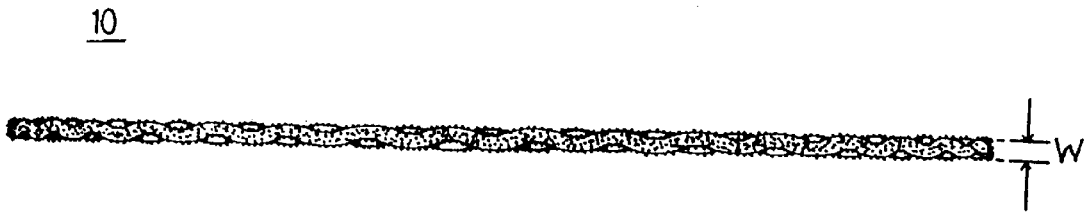
FIG. 2 is a view along arrow A—A in FIG. 1.
Figure 3:
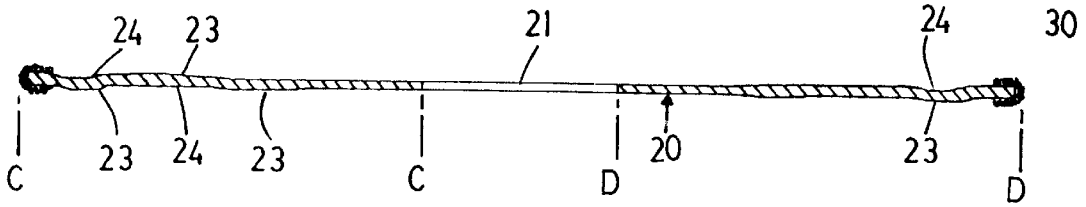
FIG. 3 is a cross sectional view along B—B in FIG. 1.
Figure 4:
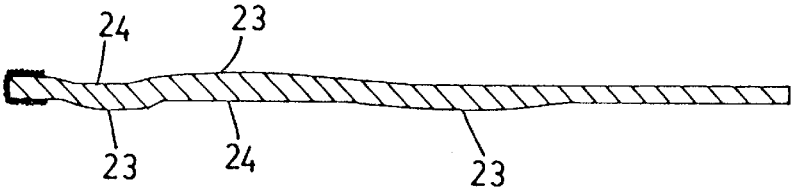
FIG. 4 is an enlarged view of a portion C—C in FIG. 3.
Figure 5:
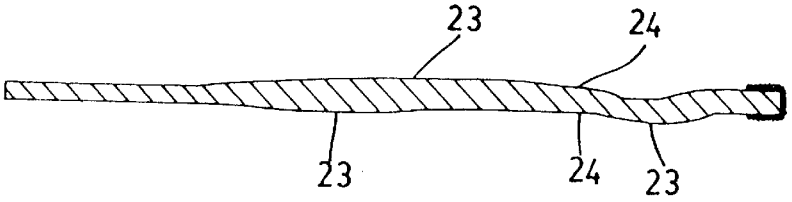
FIG. 5 is an enlarged view of a portion D—D in FIG. 3.
Figure 6:
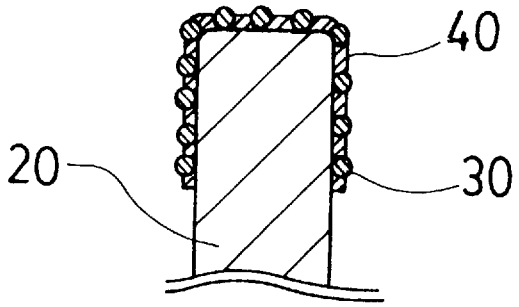
FIG. 6 is an enlarged cross sectional view illustrating a joined state between a substrate and diamond abrasive particles.
Figure 7:
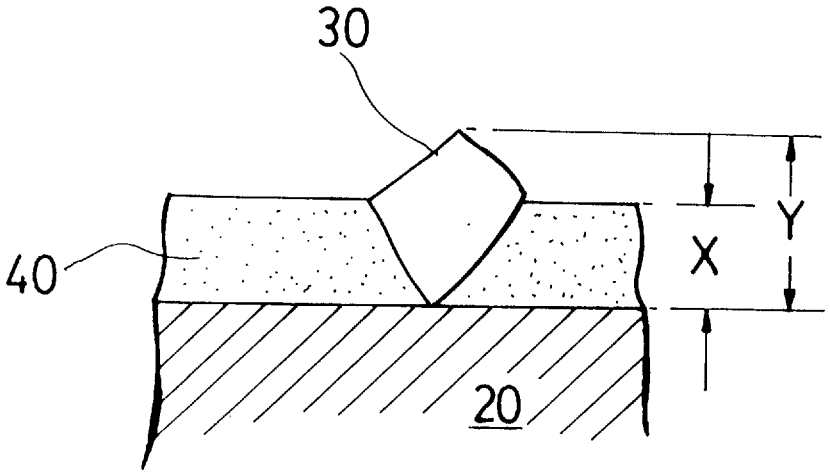
FIG. 7 is an enlarged fragmentary cross sectional view illustrating a deposition state of a diamond abrasive particle.
Figure 8:
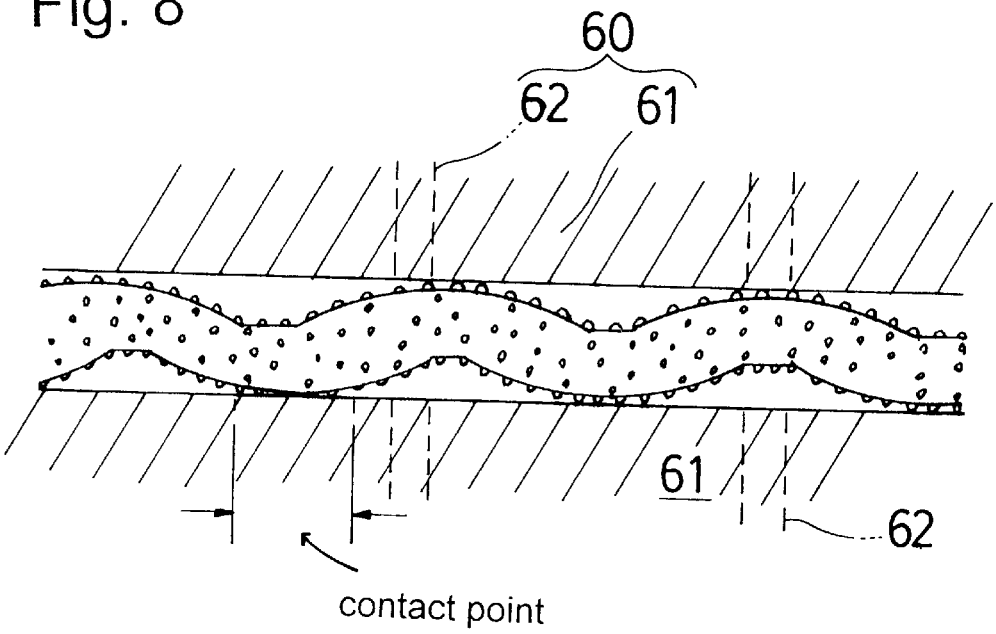
FIG. 8 is an explanatory fragmentary view illustrating the state of cutting.
Figure 9:
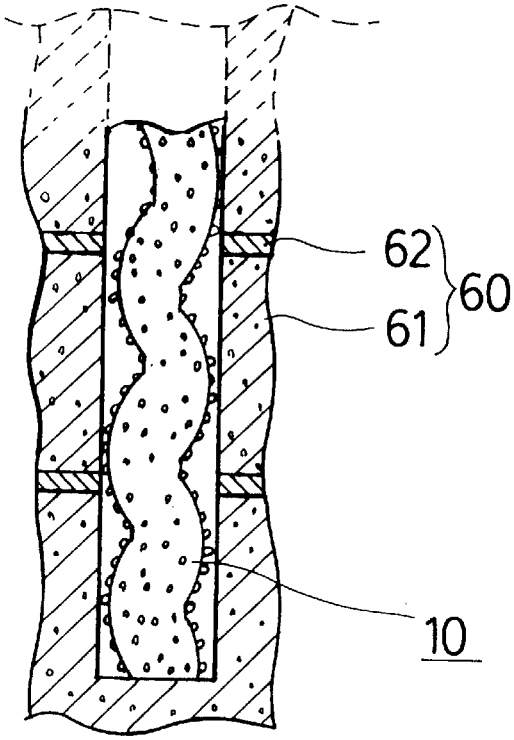
FIG. 9 is an explanatory fragmentary view illustrating the state of cutting.

FIGS. 1 to FIG. 9 show a preferred embodiment and FIGS. 10 to FIG. 14 show another embodiment of the present invention. FIG. 1 is a front elevational view of a diamond wheel according to the present invention, FIG. 2 is a view taken along arrow A—A in FIG. 1, FIG. 3 is a cross sectional view taken along arrow B—B in FIG. 1, FIG. 4 is an enlarged view of a portion C—C in FIG. 3, FIG. 5 is an enlarged view of a portion D—D in FIG. 3, FIG. 6 is an enlarged cross sectional view illustrating a joined state between a substrate and diamond abrasive particles, FIG. 7 is an enlarged fragmentary cross sectional view illustrating a deposition state of a diamond abrasive particle, FIG. 8 is an explanatory fragmentary view illustrating the state of cutting and FIG. 9 is an explanatory fragmentary view illustrating the state of cutting.

An electrodeposited diamond wheel 10 in this embodiment is used for cutting a composite material 60 comprising a heat-softening material 61 and a reinforcing material 62. The heat-softening material 61 is softened or melted by heat and includes thermoplastics such as thermoplastic elastomers, fiber reinforced thermoplastics, GRTP (glass fiber reinforced thermoplastics), CRTP (carbon fiber reinforced thermoplastics), natural rubbers and thermoplastic resins.

The reinforcing material 62 includes steel materials, steel wires, carbon fibers, reinforcing glass fibers, minerals (including stone materials) and the like.

Examples of the composite material 60 can include vehicles tires, caterpillar treads made of rubber and high pressure rubber hoses, as well as other composite materials 60 containing various kinds of reinforcing material 62.

The diamond wheel 10 in this embodiment comprises a circular disc substrate 20, and diamond abrasive particles 30 as the main constituents. and a plating layer 40 for fixing the circular substrate 20 and the diamond abrasive particles 30. The circular substrate 20 in this embodiment is a metal plate having a low thermal expansion coefficient such as an Ni30–50%—Fe alloy. Specifically, invar or Fe-36% Ni alloy is used. As shown in FIG. 1, the circular substrate 20 has an attaching aperture 21 formed at a center for attachment to a rotational device (not illustrated) that rotates the diamond wheel 10, and a plurality of cooling apertures 22 formed each at a predetermined distance from the attaching aperture 21 to the outer circumferential direction and each at a predetermined pitch. The substrate 20 is assumed to have a 4 inch diameter.

Ridges 23, each having an arcuate cross sectional shape, and planar grooves 24 are formed as corrugations on both surfaces of the circular substrate 20. In this embodiment, the ridges and the grooves are alternately formed on both surfaces of the circular substrate 20 alternately and arranged regularly, but the substrate 20 may be constituted also such that the ridges 23 and the grooves 24 continuously but irregularly made by disposing ridges 23 of increased width (circumferential direction) together.

The height of a ridge 23 is gradually increased toward the outer circumference. Further, the width of the ridge 23 is decreased toward the center of the substrate 20. The beginning of the ridge 23 in this embodiment is formed at a relatively short distance from the attaching aperture 21 as can be seen from FIG. 1. This feature is different from the embodiment shown later in FIG. 10.

The ridge 23 and the groove 24 are curved in a vortex shape, which is formed in an arcuate shape radially in a direction opposite to the intended rotational direction of the diamond wheel 10.

Further, as shown In FIG. 2, it is adapted such that a width W defined by a ridge 23 on one surface and a ridge 23 on the other surface of a corrugation situated at the outer circumference of the substrate 20 is the largest width of the substrate 20.

Then, diamond abrasive particles 30 are electrodeposited on both surfaces at the outer circumference of the circular substrate 20. That is, the ridges and grooves are formed as corrugations on both surfaces of the circular substrate 20, and the diamond abrasive particles 30 are electrodeposited on the outer circumference of the corrugations to form a cutting edge, and the cutting edge is corrugated in a shape conforming to the substrate 20.

Since the diamond abrasive particles 30 are electrodeposited (by an electroplating method), they are fixed as one layer to the substrate 20 by way of the plated layer 40. The size of the diamond abrasive particles is suitably within a range of from 30 to 80 mesh and, preferably, within a range of from 40 to 60 mesh.

Referring to the particle size, there are two aspects in the cutting of the composite material 60. One is heat generation in the heat-softening material 61 by friction and the other is the necessity of cutting a hard material since the composite material comprises the reinforcing material 62. Accordingly, while it is preferred that the diamond abrasive particle 30 is smaller for the cutting of the reinforcing material 62, the reduction of the size results in a disadvantage that the particle is covered by the heat-softening material 62 as the friction increases and loses its cutting performance. The above-mentioned range is preferred in view of the results of experiments.

Further, since an electroplating method is adopted as a means for securing the diamond abrasive particles to the substrate 20 to make the diamond abrasive particles 30 the cutting edge, all the diamond abrasive particles 30 can be protruded from the plated layer 40 by a predetermined protruding amount and can serve as the cutting edge. As shown in FIG. 7, the protrusion amount is represented as "protrusion amount=Y−X". Then, the portion in contact with the work to be cut (composite material 60) can be decreased and heat generation reduced during grinding (cutting).

The burying ratio of the diamond abrasive particle 30 to the plating layer 40 is represented as X/Y×100 as shown in FIG. 7, and is set to 60%–80%. If the burying ratio is less than 60%, the cutting performance is satisfactory because of the large amount of protrusion, but the diamond abrasive particles 30 are dislodged by the exerting force exerted by cutting (the force increases as the diamond cutting edge is abraded). This phenomenon becomes more significant as the burying ratio becomes smaller. Accordingly, a burying ratio of less than 60% shortens the working life, which is not practical.

On the other hand, if the burying ratio exceeds 80%, the protruding amount of the diamond abrasive particle 30 from the plating layer 40 is decreased causing contact between the work to be cut (composite material 60) and the plating layer 40 or making it impossible to discharge cutting dusts during cutting, which results in heat generation and makes cutting impossible. This effect becomes more significant as the burying ratio is increased, which is not appropriate.

That is, when the composite material 60 comprising the heat-softening material 61 and the reinforcing material 62 is cut, the reinforcing material 62 can be cut easily like that in the prior art by the diamond abrasive particle layer. However, in a case of cutting the heat-softening material 61, heat of friction is generated between the diamond wheel and heatsoftening material 61 as a work to be cut by the high speed rotation of the diamond wheel, and the heat softens or melts the heat-softening material 61 and the material is deposited on the diamond abrasive particles to cover the entire surface of the diamond article particles. Thus, the diamond abrasive particles are deprived of the cutting (grinding) performance. Accordingly, heat of friction is further generated to make the cutting impossible.

However, according to the present invention, as shown in FIG. 8 and FIG. 9, the diamond abrasive particles 30 are in contact with the composite material 60 only at the ridges 23 of the corrugations during cutting. Further, since the substrate is composed of a metal having a low heat expansion coefficient, thermal deformation is reduced and the substrate is kept in a state of reduced contact with the work to be cut during use. Further, the grooves function as a passage for a cooling air flow to prevent heat from being generated between the diamond wheel 10 and the composite material 60 as the work to be cut and, at the same time, the grooves serve as a passage for discharging cutting dust thereby enabling cutting to be conducted smoothly.

Figure 10:
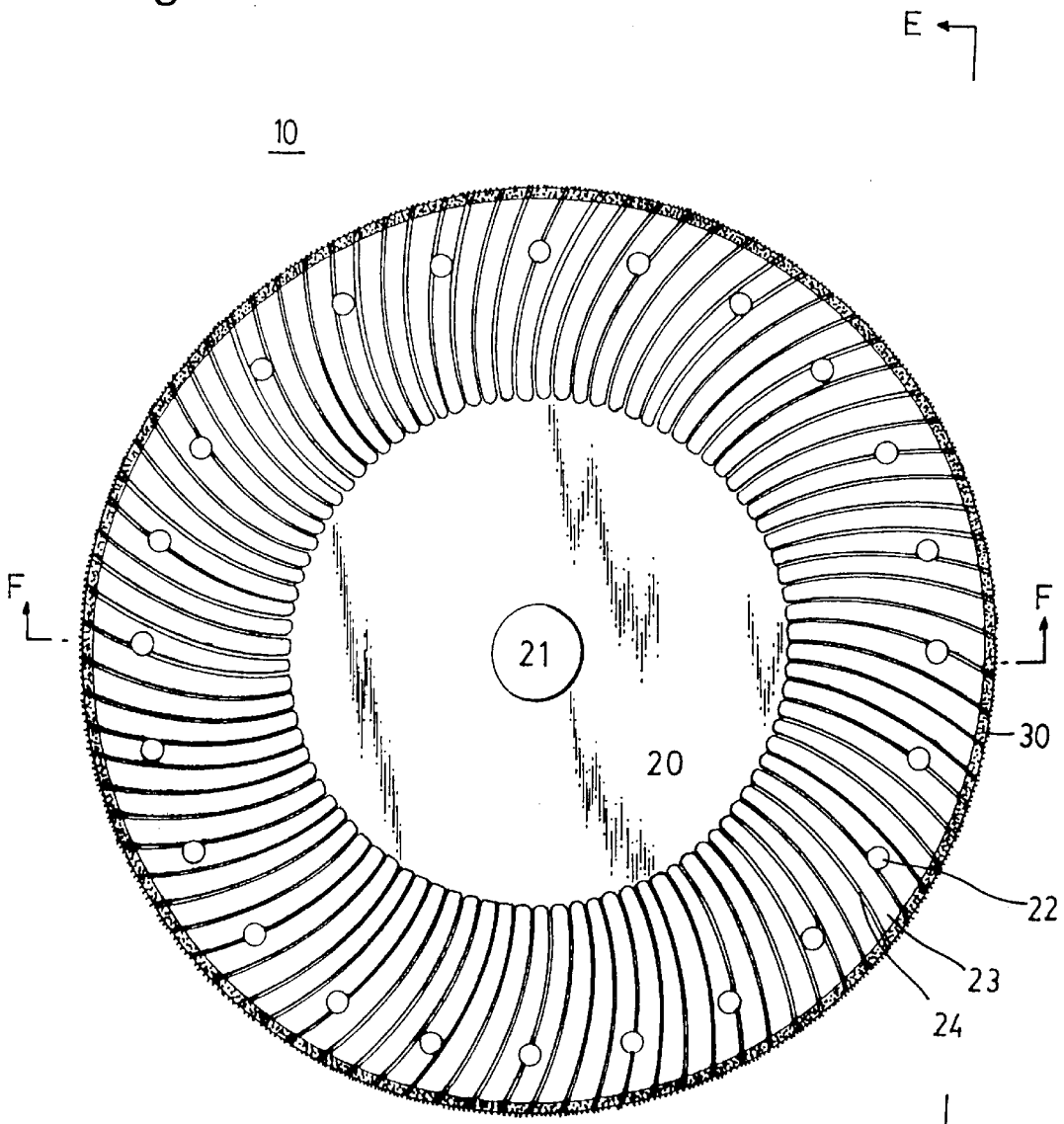
FIG. 10 is a front elevational view illustrating another embodiment of a diamond wheel.
Figure 11:
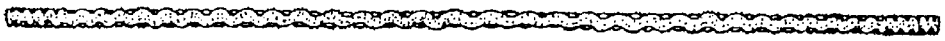
FIG. 11 is a view taken along arrow E—E in FIG. 10.
Figure 12:
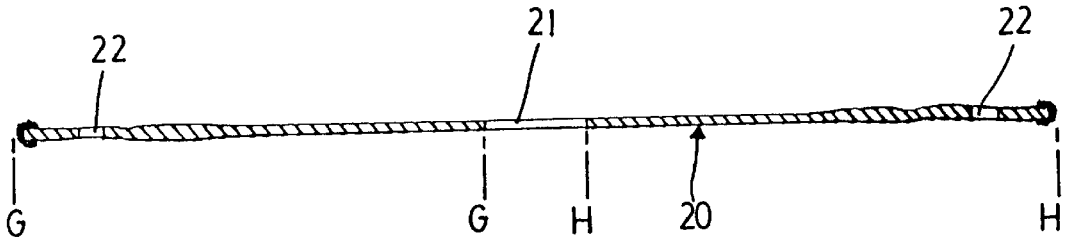
FIG. 12 is a cross sectional view taken along arrow F—F in FIG. 10.
Figure 13:
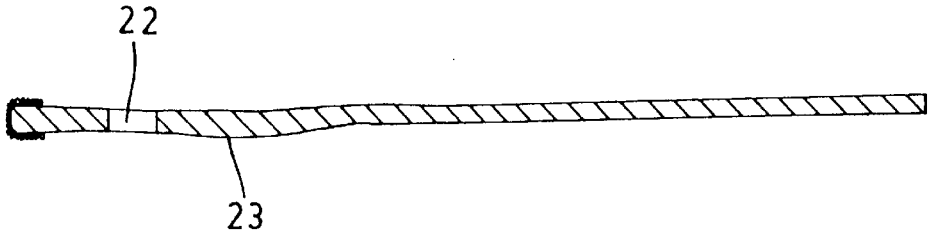
FIG. 13 is an enlarged view of a portion G—G in FIG. 12.
Figure 14:
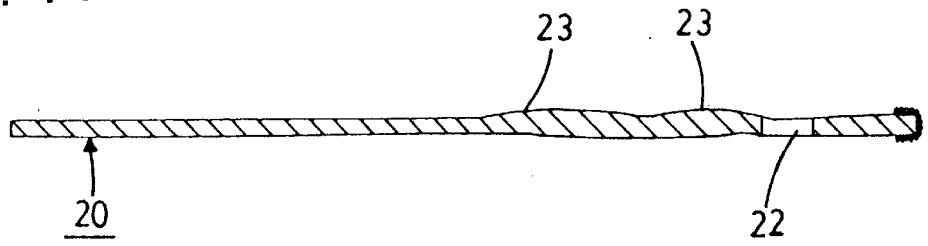
FIG. 14 is an enlarged view of a portion H—H in FIG. 12.

FIG. 10 is a front elevational view of a diamond wheel illustrating another embodiment of the present invention, FIG. 11 is a view taken along arrow E—E in FIG. 10, FIG. 12 is a cross sectional view along arrow F—F in FIG. 10, FIG. 13 is an enlarged view of a portion G—G in FIG. 12; and FIG. 14 is an enlarged view of a portion H—H in FIG. 12.

In the embodiment shown in FIG. 10 to FIG. 14, the basic constitution is the same as that in the previous embodiment, but the corrugations are formed starting from a position about at one-half of the radius of the substrate 20. In addition, the number of the ridges 23 and the grooves 24 constituting the corrugations is increased. Further, the cooling apertures 22 are formed also in an increased number. In this embodiment, the substrate 20 is assumed to have a 12 inch diameter. Other constitutions are the same as those in the previous embodiment.

What is claimed is:

1. An electrodeposited diamond wheel for cutting a composite material comprising a heat softening material and a reinforcing material, wherein the diamond wheel comprises:

a circular substrate having a center, two opposing surfaces and an outer circumference, an attaching aperture formed at the center and a plurality of cooling apertures formed each at a predetermined distance from the attaching aperture toward the outer circumference and each at a predetermined pitch and diamond abrasive particles electrodeposited on the outer circumference of the circular substrate, wherein ridges and grooves are formed on both surfaces of the circular substrate, said ridges and grooves extending radially and forming corrugations on said surfaces, and said diamond abrasive particles are electrodeposited on an outer circumferential edge of the corrugations to form a cutting edge, the cutting edge having a corrugated shape conforming to the corrugations on the substrate.

2. An electrodeposited diamond wheel as defined in claim 1, wherein the ridges and the grooves are formed alternately on the surfaces of the circular substrate.

3. An electrodeposited diamond wheel as defined in claim 1, wherein a size of the diamond abrasive particles is within a range of from 30 to 80 mesh.

4. An electrodeposited diamond wheel as defined in claim 2 or 3, wherein a burying ratio of the diamond abrasive particles is from 60% to 80%.

5. An electrodeposited diamond wheel as defined in claim 3, wherein the burying ratio of the diamond abrasive particle is from 60% to 80%.

6. An electrodeposited diamond wheel as defined in claim 3, wherein the size of the diamond abrasive particles is within a range of from 40 to 60 mesh.

7. An electrodeposited diamond wheel as defined in claim 1, wherein the height of each of said ridges gradually increases toward the outer circumference.

8. An electrodeposited diamond wheel as defined in claim 1, wherein the ridges and the grooves have an arcuate shape in a radial direction.

9. An electrodeposited diamond wheel as defined in claim 1, wherein the thickness of the substrate defined by a ridge on one surface and a ridge on an opposite surface of corrugations situated at the outer circumference of the substrate is a greatest thickness of the substrate.

10. An electrodeposited diamond wheel as defined in claim 1, wherein the substrate is made of a metal having a low expansion coefficient.

* * * * *